US005104568A

United States Patent [19]

Shaw, Jr. et al.

[11] Patent Number: 5,104,568

[45] Date of Patent: Apr. 14, 1992

[54] GRANULAR DETERGENT COMPOSITIONS BUILT WITH 2,2'-OXODISUCCINATE AND ZEOLITE A, PROCESS TO MAKE SAME, AND AGGLOMERATED DETERGENCY BUILDER

[75] Inventors: John H. Shaw, Jr.; Robert Mermelstein, both of Cincinnati, Ohio

[73] Assignee: The Procter & Gamble Company, Cincinnati, Ohio

[21] Appl. No.: 616,278

[22] Filed: Nov. 20, 1990

Related U.S. Application Data

[63] Continuation-in-part of Ser. No. 539,650, Jun. 18, 1990.

[51] Int. Cl.[5] ..... C11D 3/22; C11D 9/18; C11D 11/00; C11D 17/06

[52] U.S. Cl. ..... 252/174.18; 252/174.17; 252/174.19; 252/174.25; 252/174; 252/DIG. 11

[58] Field of Search ..... 252/174.19, 174.25, 252/135, 174.17, 174.18, 174, DIG. 11

[56] References Cited

U.S. PATENT DOCUMENTS

| | | | |
|---|---|---|---|
| 3,128,287 | 4/1964 | Berg | 260/346.8 |
| 3,635,830 | 1/1972 | Lamberti et al. | 252/152 |
| 3,939,100 | 2/1976 | Hau et al. | 252/532 |
| 3,985,669 | 10/1976 | Krummel et al. | 252/116 |
| 4,019,998 | 4/1977 | Benson et al. | 252/135 |
| 4,077,897 | 3/1978 | Gault | 252/99 |
| 4,089,795 | 5/1978 | Bailey et al. | 252/135 |
| 4,116,852 | 9/1978 | Bailey et al. | 252/135 |
| 4,123,390 | 10/1978 | Sherman et al. | 252/455 Z |
| 4,131,558 | 12/1978 | Bailey et al. | 252/135 |
| 4,180,485 | 12/1979 | Llenado | 252/532 |
| 4,231,890 | 11/1980 | Yagi et al. | 252/186 |
| 4,303,557 | 12/1981 | Rose | 252/527 |
| 4,414,130 | 11/1983 | Cheng | 252/140 |
| 4,534,880 | 8/1985 | Kosal et al. | 252/174.13 |
| 4,605,509 | 8/1986 | Corkill et al. | 252/131 |
| 4,663,071 | 5/1987 | Bush et al. | 252/174 |
| 4,689,167 | 8/1987 | Collins et al. | 252/95 |
| 4,798,907 | 1/1989 | MacBrair et al. | 562/583 |
| 4,818,292 | 4/1989 | Iley et al. | 106/210 |
| 4,959,409 | 9/1990 | Heinzman et al. | 525/61 |

*Primary Examiner*—Paul Lieberman
*Assistant Examiner*—Erin Higgins
*Attorney, Agent, or Firm*—R. C. Witte; J. J. Yetter; R. A. Dabek

[57] ABSTRACT 2,2'-oxodisuccinate detergent builder salts (ODS), especially tetrasodium 2,2'-oxodisuccinate, are difficult to dry and tend to pick up water due to the hygroscopicity of the 2,2'-oxodisuccinate: yet the present invention secures improved granular built detergent compositions comprising ODS by an aqueous ODS/zeolite coagglomeration process, the resulting agglomerate being remarkably stable and nonhygroscopic. Other detergent ingredients, such as perborate bleach, surfactants and the like, can be dry-mixed with the agglomerates to form fully-formulated granular detergents. The invention encompasses the agglomeration process, the ODS agglomerates and granular detergent compositions containing same.

22 Claims, No Drawings

GRANULAR DETERGENT COMPOSITIONS BUILT WITH 2,2'-OXODISUCCINATE AND ZEOLITE A, PROCESS TO MAKE SAME, AND AGGLOMERATED DETERGENCY BUILDER

This is a continuation-in-part of application Ser. No. 07/539,650, filed on June 18, 1990.

TECHNICAL FIELD

The present invention relates to granular laundry detergent compositions and to methods for their manufacture. More specifically, the invention relates to methods of overcoming hygroscopicity problems of 2,2'-oxodisuccinate detergency builders, especially tetrasodium 2,2'-oxodisuccinate; and to the builder agglomerate and granular laundry detergent compositions achieved by solving such problems.

BACKGROUND OF THE INVENTION 2,2'-oxodisuccinate builder salts, e.g., tetrasodium 2,2'-oxodisuccinate, are attractive and efficient non-phosphorus detergency builders which despite being known since the 1960's have apparently eluded large-scale commercialization.

2,2'-oxodisuccinates are believed to have been first disclosed in U.S. Pat. No. 3,128,287, Berg, issued Apr. 7, 1964. Detergent compositions comprising 2,2'-oxodisuccinate as builder are disclosed in U.S. Pat. No. 3,635,830, Lamberti et al, issued Jan. 18, 1972. 2,2'-oxodisuccinic acid and the tetrasodium salt are freely water-soluble and are understood to act as a builder at least in part by complexing in aqueous solution with the calcium and/or magnesium ions which constitute a major fraction of ions found in wash-water, these latter ions being termed "water hardness".

Another well-known class of laundry detergent ingredients are the zeolites. Zeolite A, especially the sodium-exchanged form (Na-A) is an established laundry detergent builder. See U.S. Pat. No. 4,605,509, Corkill et al, issued Aug. 12, 1986. Zeolite A is substantially insoluble in water, at least by comparison with 2,2'-oxodisuccinate, and is understood to act as a builder, at least in part by trapping water hardness, especially calcium ions, in the unusual "cages" of its molecular structure.

Zeolite A is readily available in industry and is especially useful for detergency building purposes when it is in the 1–10 micron size range.

Recently, it has also become possible to synthesize 2,2'-oxodisuccinate using the attractive method of U.S. Pat. No. 4,798,907, MacBrair, Jr., et al, issued Jan.17, 1989.

The terms "2,2'-oxodisuccinate" and "oxydisuccinate" (apparently synonymous for literature search purposes) also appear with frequency in the literature, especially in recitals of builders for laundry detergent formulae. Exhaustive recital of these references (in excess of one hundred) is not possible here. See, for example U.S. Pat. No. 4,689,167, Collins et al, issued Aug. 25, 1987; U.S. Pat. No. 4,131,558, Bailey et al, issued Dec. 26, 1978; U.S. Pat. No. 4,116,852, Bailey et al, issued Sept. 26, 1978; U.S. Pat. No. 4,089,795, Bailey et al, issued May 16, 1978; U.S. Pat. No. 4,019,998, Benson et al, issued Apr. 26, 1977 and U.S. Pat. No. 3,939,100, Hau et al, issued Feb. 17, 1976. Likewise, there is a great number of disclosures of the use of Zeolite A in laundry detergent compositions.

In light of the extensive literature, it is remarkable that 2,2'-oxodisuccinate is still not actively being used in commerce, especially as a detergency builder.

A significant problem not previously believed to have been reported in the 2,2'-oxodisuccinate literature is that when 2,2'-oxodisuccinate builders are conventionally spray-dried to make a granular laundry detergent with other detergent ingredients such as zeolite builders, detergent surfactants and the like, they produce hygroscopic detergent granules which tend to "cake" or become sticky on storage, especially at high humidity. The severe hygroscopicity of tetrasodium 2,2'-oxodisuccinate can be graphically illustrated simply by overnight exposure of freeze-dried solid tetrasodium 2,2'-oxodisuccinate to a humid atmosphere, when a paste or even a liquid is formed owing to the high water absorption from the atmosphere.

The present invention is therefore directed at providing the granular laundry detergent formulator with a practical and useful solution to the 2,2'-oxodisuccinate hygroscopicity problem.

More specifically, it is an object herein to provide a process for making a built granular laundry detergent wherein at least a portion of the builder component is 2,2'-oxodisuccinate, especially in agglomerated form.

It is a further object to provide novel 2,2'-oxodisuccinate-containing agglomerates generally to the detergent formulator.

A third object is the provision of granular laundry detergent compositions formulated with the agglomerates of the invention.

Other objects, such as the provision of useful fully-formulated granular detergent products, are also secured, as will be seen from the following disclosure.

All percentages and proportions herein are by weight unless otherwise indicated.

SUMMARY

Succinctly stated, this invention improves a granular built laundry detergent composition wherein the builder comprises 2,2'-oxodisuccinate (e.g, tetrasodium 2,2'-oxodisuccinate, typical of what is hereinafter intended by the abbreviation "ODS" and zeolite A. Such compositions tend, as noted, to cake by virtue of the hygroscopicity of the ODS.

The present invention provides the improvement which comprises: preparing said laundry detergent composition by a process characterized by the steps of: (a) coagglomerating the ODS with zeolite A separately from the making of the balance of the granular built laundry detergent composition; and (b) mixing the ODS/zeolite agglomerate particles produced in step (a) with the balance of said granular built laundry detergent composition.

Without intending to be limited by theory, at the heart of this invention is the surprising finding that although there are conditions under which zeolite A can apparently be mixed with 2,2'-oxodisuccinate without significantly improving the hygroscopicity of the latter (e.g., when the detergent ingredients are all conventionally spray-dried), if the ODS and zeolite are brought together under agglomerating, as distinct from spray-drying or simple solids mixing conditions, a new and useful ODS/zeolite composition with significantly reduced hygroscopicity and numerous other advantageous properties is produced.

The above-identified "balance" of the granular laundry detergent is the sum of all the components of the detergent composition other than the ODS/zeolite agglomerate, and is generally comprised of particulate detergent ingredients. It is typically a spray-dried detergent powder although alternate processes for making it, such as flaking, extrusion or the like may be equally practical; and it generally comprises from about 5% to about 95%, preferably from about 40% to about 80%, more preferably still from about 65% to about 85% of the detergent composition as a whole. For best results, the balance is of course preferably substantially free from ODS. In certain preferred embodiments of the invention, it is also substantially free from zeolite; that is to say, all the ODS and zeolite of the granular laundry detergent are found in the ODS/zeolite agglomerate.

Conveniently, agglomeration according to the method of the invention requires only water, zeolite A and ODS; and it can be carried out in a conventional pan agglomerator. The content of agglomerate in the granular laundry detergent composition is generally from about 5% to about 95%, more preferably from about 15% to about 60%, more preferably still, from about 15% to about 35%.

In its composition embodiments, the invention also provides a composition of matter adapted for use as a builder for granular laundry detergents, in the form of agglomerates which are the product of water-agglomerating zeolite A and ODS: these generally comprise: (i) from about 5% to about 35%, preferably from about 15% to about 25% by weight ODS (preferably consisting essentially of tetrasodium 2,2'-oxodisuccinate); (ii) from about 35% to about 70% zeolite A (preferably from about 50% to about 70%, most preferably from about 55% to about 65% zeolite A: very preferably this component consists essentially of 1-10 micron zeolite Na-A, dry basis) and (iii) water, preferably no more than about 30%, more preferably from about 10% to about 20%, with the water being wholly or largely in the bound state.

Adding flexibility for the detergent formulator, it is also possible to have present in the agglomerate-making a water-crystallizable inorganic salt, such as sodium carbonate. Sodium carbonate can be present at low levels, e.g., about 1% to about 5%, with little impact on the properties of the agglomerate. This is fortunate since low levels of sodium carbonate sometimes contaminate technical grades of zeolite and/or ODS. If sodium carbonate is used at an appreciable level, satisfactory agglomerates can still be made which will typically contain from about 25% to about 35% zeolite A and from about 25% to about 35% sodium carbonate, provided that the sum of zeolite A plus water-crystallizable inorganic salt is from about 50% to about 70%. Such embodiments do, however, tend to absorb water to a greater extent than low-carbonate-level or carbonate-free embodiments of the agglomerates of this invention.

Although it is not intended to generally exclude embodiments of the invention wherein the water-crystallizable inorganic salt is other than sodium carbonate (sodium sulfate, for example, being a conceivable substitute) it should be noted that salts known to adversely affect the calcium sequestration capacity or calcium sequestration rate of zeolite Na-A are preferably avoided, or their presence minimized herein. Such salts are typically highly alkaline as illustrated by sodium hydroxide and the water-soluble sodium silicates. Impurity levels of such salts, e.g., the normally analyzable impurity levels of such salts in detergent-grade zeolite Na-A are, of course, tolerable; but for optimum results, the zeolite is water-washed before agglomerating with ODS.

ODS agglomerates in accordance with the invention are generally spheroidal, glassy, free-flowing and low in hygroscopicity; these agglomerates are visually pleasing, have high density (e.g., about 1000 grams/liter which is desirable for the formulator of compact granular detergents), possess outstanding resistance to compression, are not friable to the extent that they can freely be pneumatically transported in the detergent plant without breaking up, dissolve freely to leave equal or less residue on laundered fabrics as compared with otherwise processed mixtures of the components, are readily dry-mixed with the balance of the granular detergent composition and have numerous other advantages.

Although as noted the invention includes water-crystallizable salt-containing embodiments, the ODS agglomerates of this invention in their most unusual and preferred form contain only ODS builder salts, zeolite A and water: such agglomerates have the advantage of simplicity in not requiring any inorganic salts or indeed any separate organic binder whatever. Conventional agglomeration of detergent ingredients in contrast usually requires crystal-forming inorganic salts such as sodium carbonate to be present.

In view of the hygroscopicity of ODS when incorporated in the art-disclosed fashion into a conventionally spray-dried granule (even when zeolite A is present), it is remarkable that it has now proved possible, as taught herein, to agglomerate this combination of ingredients to form particles with such highly desirable handling characteristics. It is further remarkable that the resistance to water-pickup, both of the agglomerates and of detergent compositions into which they are dry-mixed, is significantly improved. Thus in one especially preferred embodiment made simply from ODS, zeolite and water, the invention encompasses a composition consisting essentially of agglomerates having a mean particle size in the range from about 500 micron to about 1100 micron comprising the aforementioned levels of 2,2'-oxodisuccinate builder salts (preferably consisting essentially of tetrasodium 2,2'-oxodisuccinate) and the aforementioned levels of zeolite A (preferably consisting essentially of 1-10 micron zeolite Na-A); said agglomerates having a hygroscopicity, determined (typically, gravimetrically) by net water gain after equilibration at a temperature of 21° C. for a period of 7 days at two humidity levels, namely 50% and 80% relative humidity (RH), of about 10% or less (50% RH) and about 60% or less (under the very severe condition of 80% RH).

Although the hygroscopicity advantages of the latter embodiment can be matched when up to about half of the zeolite is substituted by sodium carbonate, only an agglomerate having relatively high zeolite levels and relatively low sodium carbonate levels (typically about 5% or less, more preferably 1% or less) will approach the excellently low hygroscopicity of an even more highly preferred embodiment of the invention consisting essentially of agglomerates comprising: (i) from about 15% to about 25% tetrasodium 2,2'-oxodisuccinate and (ii) from about 55% to about 65% 1-10 micron zeolite Na-A provided that the sum of said components (i) and (ii) is from about 75% to about 85% and (iii) from about 10% to about 20% water (water contents of agglomerates herein being generally specified on a "freshly made" basis); such agglomerates have a hygroscopicity, determined (typically, gravimetrically) by net water gain after equilibration at a temperature of 21° C. for a period of 7 days at 50% and 80% relative humidity (RH), of about 1% or less (50% RH) and about 30% or less (80% RH).

In its detergent composition embodiments, the present invention also encompasses the desirable substantially non-hygroscopic granular detergent compositions made possible by the invention. These generally comprise (i) at least 5%, preferably from about 15% to about 25% detersive surfactant (this component typically being selected from the group consisting of anionic and nonionic detersive surfactants) and (ii) at least 5%, preferably from about 15% to about 35%, of detergency builder in the form of ODS agglomerates according to the invention. Such fully-formulated granular laundry detergents may also contain other conventional detergent ingredients, such as optical brighteners, peroxygen bleaches e.g., perborate and percarbonate, bleach activators e.g., tetraacetylethylenediamine and the like. The formulator may choose to substitute detergency builders of the art, such as phosphate builders, for a portion of the ODS agglomerate of the invention.

DETAILED DESCRIPTION OF THE INVENTION

As noted, the laundry detergent compositions of this invention comprise, in major part, conventional ingredients that are quite familiar to detergent formulators. Advantages of the granular detergent compositions of this invention include that they, like the ODS agglomerates of the invention, are substantially non-hygroscopic. They can include but do not require special binders or crispeners such as sodium silicate, clays or the like, and perform excellently for their intended purpose of laundering fabrics in an aqueous laundry bath.

As explained above, the present invention resides in the finding that when ODS is water-agglomerated with zeolite A (or, if the formulator desires, is water-agglomerated with Zeolite A and water-crystallizable inorganic salts) separately from the making of the balance of the detergent composition, unique detergency builder particles (ODS agglomerates) are formed, which in turn makes it possible to provide new and improved granular laundry detergents simply by admixing the agglomerates and conventional particulate detergent ingredients.

The zeolite

Suitable zeolites for use herein are 1–10 micron size zeolites of the kind which form roughly equidimensional crystallites (See for example Breck, "Zeolite Molecular Sieves", Wiley-Interscience, New York, N.Y, 1974. It is very preferable to have an effective builder as the zeolite component: zeolites known to be useful detergency builders and preferred for use herein include the calcium-binding zeolites, e.g., the Na-form zeolites of group 3 especially "zeolite A", for example as disclosed in German Pat. No. 2 422 655 or U.S. Pat. No. 4,605,609, Corkill et al. Conventional detergent-grade zeolite A, sodium-form (Na-A) is readily available in industry or can be synthesized as described by Breck supra. Although for purposes of clarity, weights herein are given on a dry basis, the formulator should be aware that commercially available detergent-grade zeolites generally contain about 20% water as delivered. This water does not need to be removed before making ODS agglomerates according to the invention. Detergent-grade zeolites may be highly pure, which is of course preferable, or may contain impurities provided that their level is not such as to interfere with the working of the invention.

The ODS

The ODS builder starting-material is typically that of U.S. Pat. No. 4,798,907 MacBrair et al. Although it is highly preferred to use highly pure, e.g., recrystallized or methanol-washed tetrasodium 2,2'-oxodisuccinate, it is also possible to use technical grades comprising about 85% by weight, or more, dry basis, of tetrasodium ODS. Impurities when present are usually from the synthesis, such as maleate, fumarate or malate salts.

In more detail, the term "ODS" (acronym "ODS") herein refers to a known class of materials, namely ODS builder salts of quality satisfactory for laundry detergent uses. Most simply and very preferably, ODS builders are illustrated by tetrasodium ODS, although tetrapotassium ODS and tetralithium ODS can be substituted for the sodium salt. 2,2'-oxodisuccinic acid is also usable but is not as suitable. Preferably when using the acid, pH correction or neutralization, e.g. with NaOH, is carried out in an additional pre-processing step, prior to agglomeration.

Most generally, ODS builder salts comprise anions (the predominant anion being 2,2'-oxodisuccinate) and cations (the predominant cation, especially in the preferred embodiments, being sodium). To be fit for the intended purpose, the fraction of all anions representing organic anion impurities and the fraction of all cations representing multivalent cation impurities will each generally be low, e.g., the total of all such impurities is typically less than 20% by weight dry basis of the ODS builder salt composition. In practice, this generally means that 60% or more of the anions, preferably 80% or more, are 2,2'-oxodisuccinate and 75% or more of the cations, preferably 99% or more, are water-soluble monovalent cations, preferably sodium, potassium or lithium, most preferably sodium. Organic anions other than 2,2'-oxodisuccinate, when present, should comprise 15% by weight or less, dry basis, of the ODS. Non-ODS anions are typically comprised of the anions of simple organic carboxylate salts as noted, usually nonether carboxylates such as fumarate salts, maleate salts and malate salts.

Although as noted for purposes of clarity, weights herein are given on a dry basis, the formulator should be aware that according to the present invention, it is preferred to work with the ODS component as an aqueous solution or as a concentrated aqueous slurry. Typical water contents of ODS starting-materials as received, e.g., as made using the above-referenced Mc. Brair et al process, are in the range from about 60% to about 70% (the corresponding ODS content typically being from about 30% to about 40%). It is not essential that the water in such ODS starting-materials should be removed before making agglomerates according to the invention, a significant advantage when one considers the energy costs and technical difficulty of drying ODS builder salts. However, both with transportation costs and with the best possible agglomerate compositions in mind, it is preferred to further concentrate the ODS starting-material solutions, e.g., by evaporation, to an ODS concentration in the range from about 30% to about 60%, preferably from about 50% to about 60%, prior to agglomerating with zeolite according to the invention.

Interestingly in this connection, it has been found (counter to often-observed tendencies) that ODS solubility apparently increases with increasing purity. As the ODS impurity content (see discussion hereinabove) increases, it becomes increasingly difficult to achieve a pumpable ODS solution or slurry at the highest concentrations of the above ranges. This gives yet another reason for which the agglomerate manufacturer should seek to obtain the best possible grade of ODS.

On the other hand, a remarkable finding in connection with the instant invention is that concentrated aqueous solutions of technical-grade ODS indeed tend to "gel" over a period of storage. Although pumping is difficult, such gels can in fact successfully be used as a starting-material for the preparation of ODS agglomerates which have a relatively high (e.g., 20%, or higher) ODS content.

Whether one is concerned with technical or purer grades of ODS, there is little doubt that this builder has unique properties, e.g., forming unique glassy phases during the instant agglomeration, which as is here demonstrated impact significantly on its chemical engineering.

Agglomerate optional ingredients

The agglomerates of the invention can additionally contain various optional ingredients. Agglomeration can, for example be conducted in the presence of limited amounts of sodium linear alkylbenzenesulfonates (although exclusion of this and other detersive surfactants is preferable) or of water-crystallizable inorganic salts such as sodium carbonate at levels specified in the summary hereinabove. On the other hand, it is an advantage that certain highly alkaline salts sometimes used as binders in conventional agglomeration, such as sodium silicate, do not have to be present. In the preferred embodiments, no sodium silicate is added in the agglomeration according to the invention. Sodium silicate has on occasion been implicated in diminishing the calcium sequestration rate of zeolite A, thus it is particularly advantageous that it is not a necessary component of the ODS agglomerates. In general, especially in connection with optional ingredients in preferred embodiments of the instant ODS agglomerates containing such salts, the expression "water-crystallizable inorganic salts" refers to compounds selected from sodium carbonate (soda ash), potassium carbonate and the like, as well as mixtures thereof. The preferred form of optional ingredient is anhydrous, fine powder with particle size closely matching the zeolite.

Agglomerate water content

The ODS agglomerates herein generally contain water at levels specified in the summary hereinabove. Water contents of the freshly prepared ODS agglomerates are best determined by material balance, more specifically, the water content of the agglomerate can be measured by subtracting water lost during agglomeration from the water content of the starting-materials. After hygroscopicity testing, water may also be determined gravimetrically or by any other conventional water-determination method. Care will generally be exercised to ensure that thermal decomposition of ODS does not occur to any significant extent during water content determinations.

The agglomeration of ODS and zeolite A

Essential to the practice of this invention is the provision of agglomerates of ODS and zeolite A, which are made separately from the remainder (balance) of the granular detergent composition. The agglomeration process of the invention is remarkable in its apparent lack of reliance on salt hydration to a stable state for agglomerate particle formation. In detail, the process can be illustrated as follows. Note that there does not have to be any water-crystallizable inorganic salt. In a typical preparation of an ODS agglomerate from an aqueous slurry of tetrasodium 2,2'-oxodisuccinate ($Na_4ODS$), 1-10 micron zeolite Na-A and water, the slurry consisting essentially of $Na_4ODS$ and water is first concentrated if needed, so that the water content is about 40% to about 50%. This can be done using any convenient evaporative means, such as a vacuum drum dryer. Preferably, temperatures during such pre-agglomeration evaporation are above ambient, for speed, but to avoid any ODS decomposition tendency are below about 100° C., more preferably below about 60° C.

The zeolite A (or optionally but less desirably a mixture of zeolite A with water-crystallizable inorganic salts) is loaded into an agglomerator. Any conventional agglomerator can be used, such as an inclined pan agglomerator (sometimes known as an inclined disk agglomerator), a rotary drum agglomerator, or a vertical blender/agglomerator.

Suitable agglomerating equipment is more extensively illustrated and discussed in standard works such as "Handbook of Powder Technology", by C. E. Capes, edited by J. C. Williams and T. Allen, Elsevier, 1980. See especially pages 63-96, incorporated herein by reference.

Agglomerating machines (agglomerators) are often referred to by engineers by the name of the corporation which manufactures them. Suitable agglomerator types on this basis are Eirich agglomerators, Schugi agglomerators and Lodige agglomerators. See also "Handbook of Powder Technology" supra, at page 72.

In a preferred embodiment, the agglomerates according to the present invention are made in an Eirich mixer, Machinenfabrik Gustav Eirich.

The entirety of the zeolite (or zeolite-containing solid mixture as noted) is loaded in one batch into a suitably sized Eirich agglomerator. Is should be emphasized that staged addition of zeolite during the agglomeration can lead to inferior results.

The agglomerator is set in motion, thereby forming a free-flowing moving bed "stirred bed" of zeolite A (or zeolite-containing particulate solid) in the agglomerator. The concentrated aqueous mixture of 2,2'-oxodisuccinate builder and water ("ODS slurry"), prepared as described above, is now added. The agglomeration process temperature can be mild, e.g., ambient, slightly below ambient, or above ambient. A temperature elevated above ambient provides for greater drying of the ODS agglomerate during the agglomeration process, which in turn provides particles having improved long-term physical properties and a higher ODS content than obtainable without the elevated process temperature. Excellent results are obtained at temperatures in the range from about 100° C. to about 300° C., more preferably from about 50° C. to about 150° C., even more preferably from about 100° C. to about 150° C.

The ODS slurry addition can in general be done by pouring, by spraying through a spray nozzle or (especially when the ODS slurry is very thick) by pumping it through a large orifice. Whatever precise addition method is used, it is preferred to spread the ODS slurry evenly over the stirred zeolite bed. In general, the ODS addition can be done "in one shot", can be staged or (most conveniently and preferably) can be accomplished in a single continuous addition to a zeolite bed which is being stirred at high shear. High-shear stirring of the zeolite speeds the process, allowing more rapid throughput. It also has the advantage of forming more uniform, relatively small ODS agglomerates, which are well-matched for dry-mixing with conventional detergent granules to make fully-formulated detergent products quite resistant to segregation. (The terms "dry-mixing", "admixing" and "mixing" as used in connection with mixing solid materials herein are equivalent, the term "dry-mixing" often being used by preference by engineers in the granular detergency field.)

In a preferred mode, a stream of air which can be at ambient temperature, cooled to below ambient temperature, or more preferably heated to above ambient temperature (typically about 100° C., preferably about 150° C. and relatively dry), is passed over the surface of the moving ODS/zeolite mixture during the agglomeration process. Although in general there may be passage of air throughout the process, the stage at which the air-stream produces the greatest improvement occurs when the stirred bed has already started to form discrete agglomerate particles. Apparently, the air-stream assists "detachment" of the particles. Whether by evaporation of water or by some other mechanism, the air stream thus improves the already excellent results. Regardless of how the process is carried out in terms of air-stream, stirring of the zeolite bed with its associated wet ODS is continued until substantially complete detachment of the resulting agglomerate into discrete particles. Agglomerates are secured which are spheroidal, glassy, free-flowing and low in hygroscopicity, which have outstanding resistance to compression and are not friable; the two latter characteristics are especially advantageous in view of the subsequent dry-mixing of the agglomerates with the remainder of the granular detergent composition.

If the ODS/zeolite agglomerates are not sufficiently dried during the agglomeration process, it is preferred that an additional post-drying operation, such as fluidized bed drying or aging, follow the agglomeration process. However, such steps are not essential.

While not intending to be bound by theory, it is believed that drying the agglomerated particles following the agglomeration process provides particles having improved long-term physical properties, particularly after high humidity storage. It is further believed that if the agglomerated particles are dried sufficiently during the agglomeration process through the use of heat or some other drying mechanism, the particles will possess the aforementioned improved long-term physical properties, and will have the additional benefit of having an increased ODS concentration, up to about 35% by weight, preferably from about 15% to about 25% by weight, as compared to agglomerated particles prepared without drying during agglomeration.

The agglomeration step of the granular detergent-making process of the present invention is advantageously carried out in the presence of heating, with any necessary post-drying of the agglomerate, and in the absence of added binders. In a preferred embodiment the process is completed by mixing the above-prepared agglomerate with a balance of said granular laundry detergent composition consisting of a granular detergent powder (this can be spray-dried in the conventional manner) comprising at least one detersive surfactant.

The ODS agglomeration process, and thus the overall granular laundry detergent-making process of the invention, has several advantages, including simplicity, convenience, the ability to operate (in the agglomeration stage at least) without added heating (although heating is preferred), and the ability to make excellent agglomerates without using sodium silicate as an agglomerating aid (see for comparison U.S. Pat. No. 4,528,276, Cambell et al., issued July 9, 1985 which apparently requires both sodium silicate and heat). Evidently, the major advantage as already noted, is the preparation of a conveniently handled substantially non-hygroscopic ODS builder composition, and thereby, of improved fully-formulated detergent granules.

The remainder (balance) of the detergent composition

Apart from the agglomerates described hereinabove, the granular laundry detergent compositions of this invention comprise various conventional ingredients such as detersive surfactants, and adjuncts such as detersive enzymes, bleaches, bleach activators, detergency (non-ODS) builders and the like, all well-known in the art and in commercial practice. These conventional ingredients (with the exception of perfumes and colorants which can be sprayed on and are generally low-level additives) are solids, at least when they are to be mixed with the instant agglomerates or as found the final form of granular detergent compositions according to the invention, and can take the form of spray-dried "base granules", "noodles" or other extrudates, flakes, powders, or conventionally made non-ODS agglomerates.

Detersive Surfactants

The granular laundry detergent compositions of this invention will typically contain organic surface-active agents ("surfactants") to provide the usual cleaning benefits associated with the use of such materials. Detersive surfactants (sometimes also called "detergent surfactants") useful therein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha -sulfonates of fatty acids and of fatty acid esters, and the like, which are well-known from the detergency art. In general, such detersive surfactants contain an alkyl group in the $C_9$–$C_{18}$ range; the anionic detersive surfactants can be used in the form of their sodium, potassium or triethanolammonium salts; the nonionics generally contain from about 5 to about 17 ethylene oxide groups. U.S. Pat. Nos. 4,111,855 and 3,995,669 contain detailed listings of such typical detersive surfactants. $C_{11}$–$C_{16}$ alkyl benzene sulfonates, $C_{12}$–$C_{18}$ paraffin-sulfonates and alkyl sulfates, and the ethoxylated alcohols and alkyl phenols are especially preferred in the compositions of the present type. Also useful as the surfactant are the water-soluble soaps, e.g. the common sodium and potassium coconut or tallow soaps well-known in the art.

The detersive surfactant component of the instant granular laundry detergent compositions can comprise as little as 1% of the fully-formulated detergent compositions herein, but preferably such compositions will contain 5% to 40%, even more preferably 10% to 30%, of surfactant. Mixtures of anionic surfactants such as the alkyl benzene sulfonates, alkyl sulfates and paraffin sulfonates are preferred, especially in conjunction with nonionic polyethoxylates for through-the-wash cleansing of a broad spectrum of soils and stains from fabrics.

Detersive Adjuncts

The granular laundry detergent compositions herein can contain other ingredients which aid in their cleaning performance. For example, the invention encompasses preferred embodiments in the form of granular laundry detergent compositions containing non-ODS, non-zeolite builder/metal ion sequestrant as illustrated by one or more of ethylenediaminetetraacetate, ethylenediaminedisuccinate (EDDS), 1,2-oxoethanediylbis(aspartate) (OEDBA), citrate, or polyacrylate. Such materials can be used as their art-disclosed levels. See for example U.S. Pat. No. 3,579,454 or application Ser. No. 07/392,168 filed Aug. 10, 1989, now U.S. Pat. No. 4,983,315, Glogowski et al, issued Jan. 8, 1991, incorporated by reference, for typical examples of the use of such materials in various cleaning compositions.

If sodium silicates are desired for use as builders or sequestrants, as washing machine anti-corrosion agents or even as granule crispeners in the instant detergent compositions, they will be included in the portion of the detergent composition other than the ODS/zeolite agglomerate, i.e., in the "balance" of the fully-formulated granular laundry detergent.

The fully-formulated granular laundry compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (e.g., mixtures of amylase and protease) are typically used at levels of 0.001% to 2%, and higher, in the present compositions. Enzymes are generally added to the instant compositions in the form of particulate solids, which can simply be mixed with the agglomerate and other components of the detergent balance.

Moreover, the detergent compositions herein can contain, in addition to ingredients already mentioned, various other optional ingredients typically used in commercial products to provide aesthetic or additional product performance benefits. Typical ingredients include pH regulants, perfumes, dyes, bleach, optical brighteners, soil suspending agents, bactericides, preservatives, suds control agents, soil release agents such as those of U.S. Pat. No. 4,877,896, Maldonado, Trinh and Gosselink, issued Oct. 31,1989, and the like. As known in the art, certain such ingredients can be used to advantage at very low levels but more typically, they comprise 0.5% to 30% of granular laundry detergents in the fully-formulated form.

Manufacturing the "balance of the detergent"

The portion of the instant granular detergent compositions other than the ODS-containing agglomerate can be prepared by any of the several well-known procedures for preparing commercial detergent compositions, provided that the ODS agglomerate is prepared separately and is dry mixed with the balance to complete the fully-formulated detergent composition.

Suitable manufacturing techniques include spray-drying, extrusion, rolling/flaking, and agglomeration. Particles of various ingredients can be dry-mixed in solid form. See, for example, "Detergents and textile washing: principles and practice", G. Jakobi and A. Lohr, 1987, Library of Congress Card Number 87-25299 or similar standard texts on detergent-making. In connection with processing and general handling of solid detergent ingredients, the following references are additionally instructive: Handbook of Powder Technology (publication details supra); see in particular Volume 1 entitled "Particle Size Enlargement"; and "Handbook of Powder Science and Technology", Eds. M. E. Fayed and L. Otten, Van Nostrand Reinhold, 1984, Library of Congress Card Number 83-6828.

One preferred approach useful herein is to spray-dry a slurry of detersive surfactants, non-ODS builders, and certain detersive adjuncts such as brighteners thereby forming a base granule, ODS agglomerate and enzyme particles are admixed to the base granule, forming the final granular detergent composition.

A quite different approach also capable of producing a granular laundry detergent in accordance with the invention is to form a dry-neutralized agglomerate between the acid form of an anionic detersive surfactant, alkaline inorganic salts and zeolite A and to blend the resulting composition with the ODS agglomerates of the invention, optionally adding particulate enzyme and, if desired, particulate sodium perborate.

Although mixing dry particulate materials with the ODS agglomerates to form the fully-formulated laundry detergent is the general practice, some exceptions, such ass spray-on of perfumes and dyes, have been noted hereinabove: another example of a spray-on to complete a fully formulated granular laundry detergent in accordance with the invention is to spray a molten or organic solvent-borne nonionic detersive surfactant, polyester soil release agent or the like, e.g., onto the mixture of agglomerates and other solid-form detersive ingredients, or onto the ODS/zeolite agglomerates. However, especially when the material sprayed on is relatively low-melting or has poor water-solubility, this practice is not preferred on account of the possibility either of producing a "tacky" detergent product, or of impairing the overall solubility of the granular laundry detergent.

In general, as noted supra, the practitioner will match the particle size ranges of the various dry-mixed components of the granular laundry detergent composition. It is an advantage of the ODS agglomeration process herein that it is readily adjusted by the practitioner to prepare a range of differently sized ODS agglomerate particles.

Particle size ranges of granular laundry detergents according to the invention generally range from about 50 micron to about 450 micron (mean about 200 micron) when the granular laundry detergent is to have compact form, and from about 150 micron to about 1000 micron (mean about 325 micron) for typical "one-cup" dosage products.

Without limiting the invention, the ODS agglomerates, process and granular laundry detergent compositions are further illustrated by the following examples.

EXAMPLES

Example 1

ODS agglomerates

Commercial detergent-grade sodium zeolite A (6.3 lb., water content 20%; a fine particulate in the size range 1-10 micron, obtainable from various manufacturers including W. R. Grace, Ethyl Corp., PQ Corp., —U.S; Birac Co. —Yugoslavia, Degussa G.m.b.H. —Germany; Ausidet, Mia Lanza, Laviosa, —Europe and Tosoh —Japan) is loaded into an inclined pan agglomerator (Eirich mixer, model RV-02).

The pan of the Eirich mixer is set in motion at 33 revolutions per minute (clockwise) and the rotor blade, a high-shear element, is set in motion counterclockwise at 1750 revolutions per minute.

An aqueous solution of tetrasodium 2,2'-oxodisuccinate (1.8 lbs., concentration 33%) is poured evenly over the moving bed of zeolite.

After about 3 minutes of continued stirring, high-pressure air is passed over the surface of the moving mixture for about 2 minutes while the Eirich continues in motion. Shortly thereafter, a rattling noise is heard as the product ODS agglomerates reach substantially complete detachment.

The resulting free-flowing ODS agglomerate is stable and ready for use without any further aging or conditioning. It contains about 7.5% ODS builder, about 65% zeolite A builder, about 26.5% water and about 1% impurities. On one hand, the agglomerate is quite stable to moisture pickup when stored outside a detergent carton and in equilibrium with a humid atmosphere at 50% RH (Relative Humidity). Even when the relative humidity is as high as 80%, the moisture pickup is judged significantly better relative to simple mixtures (non-agglomerated) of the ODS and zeolite components, or relative to the spray-dried ingredients in a laundry detergent granule. On the other hand, the agglomerate disperses readily when placed in water along with the balance of a granular laundry detergent composition to form an aqueous laundry bath. This efficient dispersion is important in that it avoids leaving residues on laundered fabrics.

EXAMPLE 2

Granular Detergent

A. ODS agglomerates are prepared as in Example 1.

B. Separately, a spray-dried detergent base powder is made by spray-drying conventional detersive ingredients. (Alone or with enzymes—see infra-this component serves to illustrate what is referred to elsewhere herein as "the balance of the granular laundry detergent composition.)

C. ODS agglomerates (40 parts), the base powder (59.5 parts) and particles of enzyme (0.5 parts) are mixed, thereby forming fully-formulated granular laundry detergent having the following composition:

| Ingredients | Percent |
|---|---|
| (These components come from the ODS agglomerate): | |
| Tetrasodium 2,2'-oxodisuccinate | 3.0 |
| Zeolite Na-A 1-10 micron (dry basis) | 26.0 |
| (These components come from the base powder): | |
| $C_{11-13}$ alkylbenzene sulfonate (neutralized, dry basis) | 12.0 |
| $C_{12}$–$C_{13}$ alcohol ethoxylate EO 6.5 | 1.0 |

-continued

| Ingredients | Percent |
|---|---|
| Tallow alcohol sulfate | 7.5 |
| Zeolite Na-A 1-10 micron (dry basis) | 3.0 |
| Optical brightener | 0.23 |
| Sodium carbonate (dry basis) | 14.0 |
| Perfume/minors | 0.5 |
| Sodium silicate (1.6 ratio $Na_2O:SiO_2$) | 2.0 |
| Enzymes (Savinase, 6T) | 0.5 |
| Water | to 100 |

In use, the composition of Example 2 efficiently launders fabrics in an automatic clothes washing machine. It performs well and leaves little or no residue on the laundered fabrics.

EXAMPLE 3

ODS agglomerates—different agglomerator

An aqueous solution of tetrasodium 2,2'-oxodisuccinate is quality checked by proton nuclear magnetic resonance spectroscopy (n.m.r) and high performance liquid chromatography (h.p.l.c) which shows that the impurity levels are no more than about 5% by weight. The solution is evaporatively concentrated to form an ODS slurry which is again n.m.r and h.p.l.c analyzed and found to have a total solids content of about 60%. 50.0 grams of this slurry are weighed Zeolite Na-A, as used in Example 1, about 100 g, is placed in the bowl of a Cuisinart BASIC or DLC-7 SUPER PRO model food processor having a steel high-shear cutting blade.

With the blade in motion, the ODS slurry is poured onto the moving zeolite solids. Over a period of a few minutes, the food processor is switched off intermittently so as to allow the operator to scrape any material sticking on the sides back into the agitated zone of the processor. Agglomerate beads having smooth outer surfaces and a roughly spherical appearance are formed. As mixing continues, air is passed over the surface of the agglomerates and they dry out or age over a few minutes to the point that they begin to rattle about in the processor. After about 3 minutes there is good detachment (the agglomerates do not stick to the walls of the processor or to each other to any significant extent). The processor is switched off and the ODS agglomerates are recovered.

The resulting free-flowing ODS agglomerate is stable and ready for use without any further aging or conditioning. It contains about 21% ODS builder, about 57% zeolite A builder, about 18.3% water and about 3.7% impurities.

EXAMPLE 4

ODS agglomerates

ODS agglomerates having proportions of components in accordance with Example 3 are prepared using equipment, and process details as in Example 1.

The resulting free-flowing ODS agglomerate is stable and ready for use without any further aging or conditioning. The agglomerate is sieved and the fraction having size in the range 50 to 450 microns is retained. The agglomerate contains about 21% ODS builder, about 57% zeolite A builder, about 18.3% water and about 3.7% impurities.

EXAMPLE 5

Granular Detergent

A. ODS agglomerates are prepared as in Example 4.

B. Separately, a spray-dried detergent base powder is made by spray-drying conventional detersive ingredients.

C. ODS agglomerates (29 parts), the base powder (70.5 parts) and particles of enzyme (0.5 parts) are mixed, thereby forming fully-formulated granular laundry detergent having the following composition:

| Ingredients | Percent |
|---|---|
| (These components come from the ODS agglomerate): | |
| tetrasodium 2,2'-oxodisuccinate | 6.0 |
| Zeolite Na-A 1-10 micron (dry basis) | 16.5 |
| (These components come from the base powder): | |
| $C_{12.3}$ alkylbenzene sulfonate (neutralized, dry basis) | 13.0 |
| $C_{14}$–$C_{15}$ alkyl sulfate | 5.0 |
| Zeolite Na-A 1-10 micron (dry basis) | 4.5 |
| Optical brightener | 0.3 |
| Sodium carbonate (dry basis) | 23.0 |
| Sodium silicate (1.6 ratio $Na_2O:SiO_2$) | 2.3 |
| Sodium polyacrylate, m.w. 4500 (dry basis) | 2.0 |
| PEG 8000 | 1.4 |
| DC-544 (Dow Corning) silicone/process aid | 0.1 |
| Sodium sulfate | 10.0 |
| (Additional Dry-mix) | |
| Enzymes (Savinase, 6T) | 0.5 |
| (These components are sprayed on to the final product) | |
| Perfume | 0.5 |

In use, the composition of Example 5 efficiently launders fabrics in an automatic clothes washing machine. It performs well and leaves little or no residue on the laundered fabrics.

EXAMPLE 6

ODS agglomerates—ODS/Zeolite/water-crystallizable salt

The procedure of Example 3 is repeated except that the zeolite is substituted by a 50:50 mixture (both components expressed on an anhydrous basis) of the identical zeolite with anhydrous sodium carbonate, a water-crystallizable inorganic salt.

The results are similar except that a distinct "dough" stage occurs between the initial mixing of the components and the final detachment of the ODS agglomerate particles from each other.

The resulting free-flowing ODS agglomerate contains about 22% ODS builder, about 30.7% zeolite A builder, about 30.7% sodium carbonate, about 12.7% water and about 3.9% impurities.

EXAMPLES 7-8

Granular Detergents

In the following examples, the granular detergent compositions are prepared as follows:

A. ODS agglomerates are prepared as in Example 5.

B. Other detergent ingredients with the except of perfume are solids with granulometry similar to the ODS agglomerate. A variety of suitable ingredients can be identified from Mc Cutcheon's. The ODS agglomerates and the balance of the detergent composition are dry-mixed. Perfume is sprayed on to form the final product.

The resulting detergent compositions are as follows:

| Example No. | 7 | 8 |
|---|---|---|
| Tetrasodium 2,2-oxodisuccinate | 10 | 15 |
| Zeolite Na-A (1-10 micron) | 21 | 31.5 |
| sodium silicate $Na_2O:SiO_2$ ratio 2.0 | 2 | 3 |
| $C_{12.3}$ Linear Alkylbenzenesulfonic acid, sodium salt | 20 | 15 |
| Sodium carbonate | 20 | 20 |
| sodium sulfate | 20 | 10 |
| sodium polyacrylate, m.w 4500 | 2 | 0 |
| Savinase, 6.0 T | 0.5 | 0.5 |
| Perfume | 0.3 | 0.5 |
| Water, impurities, minors . . . to | 100 | 100 |

In use, the compositions of the foregoing Examples efficiently launder fabrics in an automatic clothes washing machine. They perform well and leave little or no residue on fabrics.

EXAMPLE 9

An aqueous solution of tetrasodium 2,2'-oxodisuccinate is evaporatively concentrated to form an ODS slurry comprising 60% ODS solids.

Separately, 202.9 grams of Zeolite Na-A, as used in Example 1, are placed in the bowl of a Cuisinart DLC-7 SUPER PRO Model food processor having a steel, high-shear cutting blade.

With the blade in motion, 100.0 grams of the ODS slurry are poured onto the moving zeolite solids. Over a period of a few minutes, gummy spherical particles are formed. As mixing continues, air heated to 150° C. by a heat gun is blown into the food processor for about 30 seconds. The particles become free-flowing, detached spheres, which are recovered and ready for immediate use. A material balance on the composition indicates that all water not associated with the zeolite crystal structure is evaporated. The agglomerates contain 22% ODS builder, 59% zeolite A builder, 16% water, and 3% impurities.

EXAMPLE 10

A granular detergent composition is prepared as follows:

A. ODS agglomerates are prepared as in Example 9.

B. Separately, a spray-dried detergent base powder is prepared from conventional detersive ingredients.

C. ODS agglomerates (27.3 parts), base powder (70.4 parts), enzymes (0.3 parts), and citric acid (1.5 parts) are combined in conventional powder mixing equipment, while perfume (0.5 parts) is sprayed onto the powder.

The resulting fully-formulated laundry detergent is of the following composition:

| Ingredients | Wt. Percent |
|---|---|
| (These components come from the ODS agglomerate): | |
| Tetrasodium 2,2'-oxodisuccinate | 6.0 |
| Zeolite Na-A 1-10 micron (dry basis) | 16.1 |
| (These components come from the base powder): | |
| $C_{12}$ alkyl benzene sulfonate (neutralized) | 15.0 |
| $C_{14-15}$ alkyl sulfate | 3.0 |
| Zeolite Na-A 1-10 micron (dry basis) | 3.0 |
| Optical fluorescer | 0.5 |
| Sodium carbonate | 20.0 |
| Sodium silicate (1.6 ratio $Na_2O:SiO_2$) | 2.0 |
| Sodium polyacrylate, MW 4500 (dry basis) | 1.0 |
| PEG 8000 | 2.0 |
| Sodium sulfate | 12.0 |
| DC-544 silicone | 0.1 |

-continued

| Ingredients | Wt. Percent |
|---|---|
| (Additional Dry-Mix) | |
| Citric Acid | 1.5 |
| Enzymes (Savinase, 6T) | 0.5 |
| (Spray-on to finished product) | |
| Perfume | 0.5 |
| Water/misc. from all sources | to 100% |

In use, the composition of Example 10 launders fabrics well in an automatic clothes washing machine, leaves little or no residue on the laundered fabrics, and has acceptable physical properties under high humidity storage testing.

Alternate embodiments

In addition to the embodiments of the invention illustrated hereinabove, it is believed possible to provide alternate embodiments without departing from the spirit and scope of the invention. In such embodiments, alternate materials might for example be substituted for the zeolite A component of the ODS agglomerate. Such alternate materials should be generally be water-insoluble silicates, aluminosilicates or similar, provided that they are in the form of roughly equidimensional (that is to say "chunky" or near-spherical) crystallites in the 1-10 micron size range. Clays, such as layer aluminosilicates e.g., bentonite or montmorillonite, would in contrast not be considered suitable for substituting the zeolite component. In other alternate embodiments, the ODS agglomerates may be colored with non-staining blue or green dyes, or can be sprayed with perfumes for aesthetic appeal.

ODS agglomerates according to the invention have no known utility outside the detergency arts, e.g., they are not useful as petroleum industry-type zeolite catalyst particles etc. However, they are excellent for their detergency purpose, and very appealing to the detergent formulator even without further aesthetics modification, since they are quite white, uniquely strong and non-dusting, are free from clays, do not require hot-pressing manufacturing techniques, and do not contain amorphous silica or sodium silicate that would interfere with free dispersion in water or form residues on laundered fabrics.

What is claimed is:

1. A process for preparing a granular built laundry detergent composition wherein the builder comprises 2,2'-oxodisuccinate and zeolite A, said composition tending to be hygroscopic by virtue of the 2,2'-oxodisuccinate, the improvement of which comprises preparing said laundry detergent composition by a process characterized by the steps of: (a) coagglomerating the 2,2'-oxodisuccinate with zeolite A separately from the making of the balance of the laundry detergent composition; and (b) mixing the 2,2'-oxodisuccinate/-zeolite agglomerate particles produced in step (a) with the balance of said laundry detergent composition.

2. A process according to claim 1 comprising, in step (a), adding a concentrated aqueous mixture of 2,2'-oxodisuccinate builder and water to a stirred bed of zeolite A in an agglomerator.

3. A process according to claim 2 wherein the zeolite A consists essentially of 1-10 micron zeolite Na-A and wherein the zeolite bed is stirred at least until substantially complete detachment of the resulting agglomerate into discrete particles.

4. A process according to claim 3 wherein the 2,2'-oxodisuccinate builder consists essentially of tetrasodium 2,2'-oxodisuccinate and wherein the concentration thereof in said concentrated aqueous mixture is from about 30% to about 60%.

5. A process according to claim 4 wherein said concentration is from about 50% to about 60%.

6. A process according to claim 4 wherein step (a) is carried out at an agglomeration process temperature in the range of from about 10° C. to about 300° C.

7. A process according to claim 6 wherein step (a) is carried out in the presence of heating means, and in the absence of added binders; and wherein said balance of said granular laundry detergent composition consists of a granular detergent powder comprising at least one detersive surfactant.

8. A process according to claim 7 wherein step (a) is conducted at a temperature in the range of from about 50° C. to about 150° C.

9. A process according to claim 8 wherein said temperature is from about 100° C. to about 150° C.

10. A process according to claim 9 wherein in step (a), detachment of the agglomerate is assisted by passing a heated air-stream over the zeolite/2,2'-oxodisuccinate in the agglomerator.

11. A process according to claim 4 wherein, in addition to said 2,2'-oxodisuccinate, zeolite and water, there is present a water-crystallizable inorganic salt.

12. A composition of matter prepared by water agglomerating the components according to the process of claim 1 adapted for use as a builder for granular laundry detergents, said composition having the form of agglomerates comprising:

(i) from about 5% to about 35%, 2,2'-oxodisuccinatte builder salts and (ii) from about 35% to about 70% zeolite A.

13. A composition according to claim 12 consisting essentially of agglomerates having a mean particle size in the range from about 500 micron to about 1100 micron wherein said 2,2'-oxodisuccinate builder salts consist essentially of tetrasodium 2,2'-oxodisuccinate and said zeolite A consists essentially of 1-10 micron zeolite Na-A; said agglomerates having a hygroscopicity, determined by net water gain after equilibration at a temperature of 21° C. for a period of 7 days at 50% and 80% relative humidity (RH) respectively, of about 10% or less at 50% RH and about 60% or less at 80% RH.

14. A composition according to claim 13 comprising: (i) from about 15% to about 25% tetrasodium 2,2'-oxodisuccinate and (ii) from about 50% to about 70% 1-10 micron zeolite Na-A; wherein the water content of the agglomerate prior to hygroscopicity determination is in the range from about 10% to about 20%.

15. A composition according to claim 14 consisting essentially of agglomerates comprising: (i) from about 15% to about 25% tetrasodium 2,2'-oxodisuccinate and (ii) from about 55% to about 65% 1-10 micron zeolite Na-A provided that the sum of said components (i) and (ii) is from about 75% to about 85%; and (iii) from about 10% to about 20% water; said agglomerates having a hygroscopicity, determined by net water gain after equilibration at a temperature of 21° C. for a period of 7 days at 50% and 80% relative humidity (RH), of about 1% or less at 50% RH and about 30% or less at 80% RH.

16. A composition according to claim 12 comprising:

(i) from about 5% to about 35% tetrasodium 2,2'-oxodisuccinate;

(ii) from about 35% to about 70% 1–10 micron zeolite Na-A;

(iii) from about 10% to about 20% water; and (iv) from about 1% to about 35% of a water-crystallizable inorganic salt; provided that the sum of component (ii) plus (iv) is from about 50% to about 70%.

17. A composition according to claim 16 wherein the water-crystallizable inorganic salt is sodium carbonate.

18. A composition according to claim 17 comprising:

(i) from about 5% to about 25% tetrasodium 2,2'-oxodisuccinate;

(ii) from about 25% to about 35% 1–10 micron zeolite Na-A;

(iii) from about 10% to about 20% water; and (iv) from about 25% to about 35% of said water-crystallizable inorganic salt.

19. A granular detergent composition comprising:

(i) at least 5% detersive surfactant and (ii) at least 5% detergency builder in the form of agglomerates according to claim 12.

20. A granular detergent composition consisting essentially of an admix of two or more detergency active particulate materials, one of said particulate materials consisting of agglomerates according to claim 14 at a level of at least 5% by weight of said detergent composition; and the balance of said particulate materials comprising detersive surfactant such that the level thereof in said detergent composition is at least 5% by weight.

21. A granular laundry detergent composition according to claim 20 wherein said balance consists essentially of a spray-dried granular detergent powder.

22. A granular detergent composition according to claim 21 comprising:

(i) from about 15% to about 25% of said detersive surfactant and (ii) from about 15% to about 35% of said agglomerates.

* * * * *